United States Patent [19]

Northcote et al.

[11] 4,408,566

[45] Oct. 11, 1983

[54] BOILERS

[75] Inventors: Reginald D. Northcote, Lower Penn; Mehdi G. Mehdi, Dudley, both of England

[73] Assignee: Thorn Emi Energy Developments Limited, Burton Works, England

[21] Appl. No.: 272,034

[22] Filed: Jun. 9, 1981

[30] Foreign Application Priority Data

Jun. 10, 1980 [GB] United Kingdom ..... 8018999

[51] Int. Cl.[3] ..... F23C 11/02

[52] U.S. Cl. ..... 122/4 D; 110/245; 110/216

[58] Field of Search ..... 122/4 D; 110/245, 264, 110/216

[56] References Cited

U.S. PATENT DOCUMENTS

| | | | |
|---|---|---|---|
| 3,442,232 | 5/1969 | White | 110/216 |
| 4,270,468 | 6/1981 | Robinson et al. | 122/4 D |
| 4,273,073 | 6/1981 | Robinson | 122/4 D |
| 4,285,282 | 8/1981 | Good | 110/216 |
| 4,321,071 | 3/1982 | Sobole | 110/217 |
| 4,338,887 | 7/1982 | Leon | 122/4 D |

*Primary Examiner*—Henry C. Yuen

*Attorney, Agent, or Firm*—Spencer, Kaye & Frank

[57] ABSTRACT

A boiler comprising a furnace box, having a peripheral wall, from which products of combustion pass to a smoke box wherein the furnace box comprises a lower compartment, means to establish a fluidized bed in the lower compartment, an upper compartment, an exit connected to said upper compartment for passage of products of combustion from said furnace box, means to isolate said lower compartment from said exit except by communication through said upper compartment and through a foraminous element located in the path of the products of combustion from said lower compartment to said upper compartment.

9 Claims, 2 Drawing Figures

BOILERS

BACKGROUND OF THE INVENTION

1. Field of the Invention

This invention relates to horizontal boilers of the type, hereinafter referred to as the type described, comprising a furnace box from which products of combustion pass, generally horizontally, to a smoke box and in which there may be provided one or more passes of horizontal smoke tubes extending between the smoke box and a further smoke box or boxes. Such a boiler may be of the shell type comprising an outer shell containing the water/steam space of the boiler as well as the furnace box and the or each pass of smoke tubes, if provided.

2. Summary of the Invention

An object of the invention is to provide a boiler of the type described with a fluidised bed in the furnace box to fire the boiler. It has been found that problems arise when a fluidised bed is provided in the furnace box due to the limited height available above the bed which leads to a relatively great carry-over of fluidised material from the furnace to the rear of the boiler into the first smoke box.

Another disadvantage is that the fluidised material tends to migrate along the furnace box in the direction of discharge of products of combustion from the furnace. This is undesirable since the front of the fluidised bed could be left uncovered with subsequent short circuiting of air through the front of the bed to the detriment of the material at the back of the bed.

The present invention provides a solution to these problems.

According to the invention we provide a boiler of the type described wherein the furnace box comprises a lower compartment, means to establish a fluidised bed in the lower compartment and an upper compartment which is connected to an exit for products of combustion from the furnace box, the lower compartment being isolated from said exit except for communication through the upper compartment through a foraminous element.

The provision of the foraminous element causes the products of combustion arising from the bed to be spread across the whole of the bed area and in consequence the upward movement of the fluidised material and products of combustion is substantially reduced in velocity compared to the velocities that would be experienced if the gases left the furnace directly. Furthermore, as a result of providing the foraminous element, all the products of combustion and fluidised material rise vertically; as a consequence migration of the bed towards the discharge end of the furnace box is avoided.

The foraminous element may comprise an apertured plate, which may be made of stainless steel, located adjacent to, and spaced inwardly of, the wall of an upper part of the furnace box and extending over the majority of the length of the furnace box from a forward end thereof towards a rear end thereof and there being a duct extending downwardly from the space between the upper wall part of the furnace box and the foraminous element to a generally horizontally extending discharge duct communicating with the smoke box.

The downwardly extending duct may be bounded at one side by a plate depending downwardly from the foraminous element and having its lower end embedded in a bed of particulate material to provide a seal to said discharge duct.

The furnace box may be generally cylindrical with the Longitudinal axis of the cylinder extending horizontally and the foraminous element may be generally part circular in cross-section, the lower ends of the element being connected to the wall of the box.

The part circular cross-sectional shape may have a centre of curvature coincident with the axis of the furnace box and the lower ends of the element being connected to the wall of the furnace box by horizontally extending elements.

The foraminous element may be perforated with a greater number of holes per unit area at the front of the furnace box compared with the rear of the furnace box so as to minimise the possibility of short circuiting of gas by reducing the pressure drop across the element at the front because of the increased flow permitted.

The foraminous element may be made up of a plurality of plates overlapped longitudinally and transversely to accommodate thermal expansion and the element may be supported from the wall of the furnace box by appropriate struts and thus the element is water cooled as a result of conduction of heat through the struts to the water cooled wall of the furnace box.

BRIEF DESCRIPTION OF THE DRAWINGS

The invention will now be described in more detail by way of example, with reference to the accompanying drawings wherein.

DESCRIPTION OF THE PREFERRED EMBODIMENTS

Figure 1:
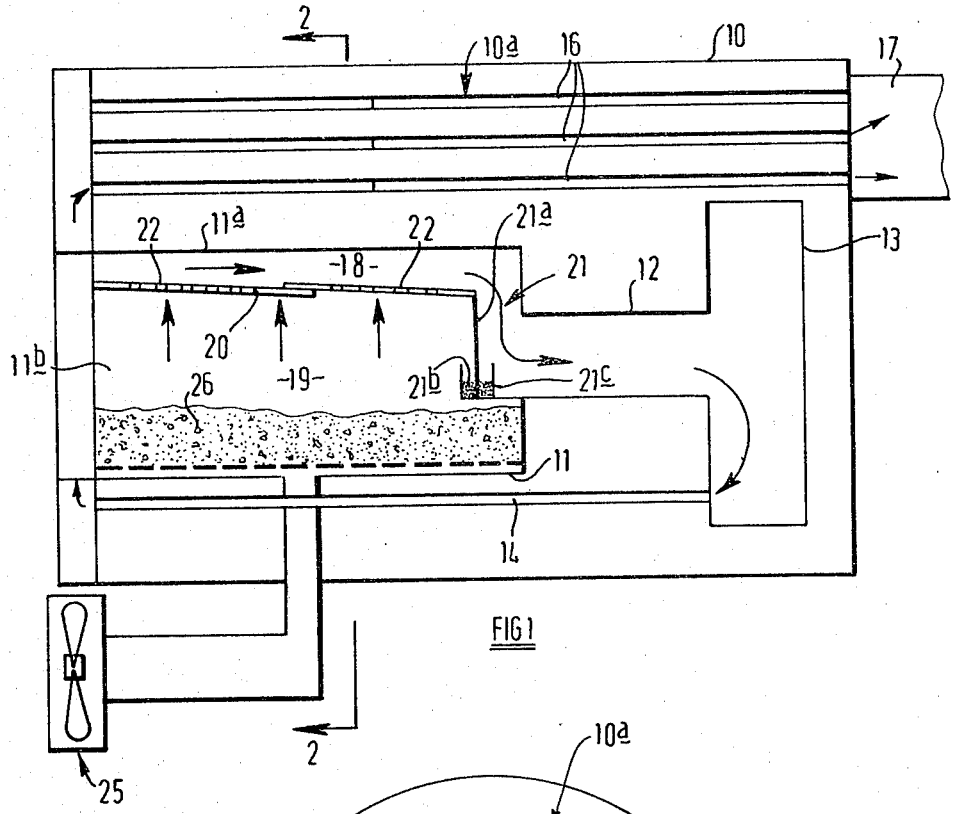
FIG. 1 is a diagrammatic longitudinal cross-sectional view through a boiler embodying the invention.

Referring to the drawings, a shell boiler is illustrated and comprises a shell 10 within which the water/steam space 10*a* of the boiler is contained, together with a furnace box 11 from which a discharge duct 12 for products of combustion extends to a first smoke box 13. A first pass of smoke tubes 14 extend from the smoke box 13 to a further smoke box 15 at the front of the furnace from which a second pass of smoke tubes 16 extend to an exit duct 17 connected to a conventional flue system.

Figure 2:
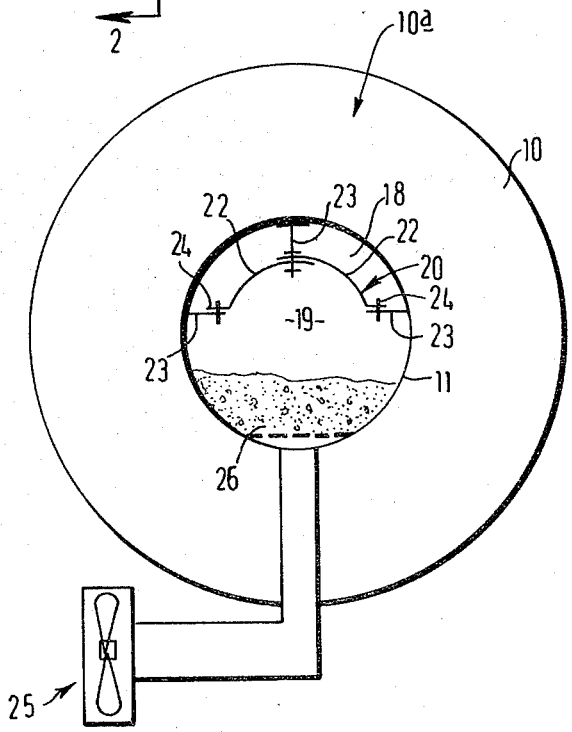
FIG. 2 is a section on the line 2—2 of FIG. 1, with parts omitted for clarity.

In FIG. 2 the details of the passes of smoke tubes and smoke boxes have been omitted.

The furnace box 11 is divided into two compartments, namely an upper compartment 18 and a lower compartment 19. The two compartments are separated by a foraminous element 20 and the upper compartment 18 is connected by a downwardly extending duct 21 with the discharge duct 12 and it will be seen that the lower compartment 19 is isolated from the duct 12 except by communication through the upper compartment 18 through the foraminous element 20.

The duct 21 is bounded at one side by a stainless steel plate 21*a* connected at its upper end to the foraminous element 20 and having its lower end embedded in a bed 21*b* of sand received in a trough 21*c* at the entrance to the duct 12. This arrangement accommodates most of the lower end of the plate 21*a* relative to the wall of the duct 12 due to thermal movement of the plate 21*a* and the foraminous element 20.

As best shown in FIG. 2, the foraminous element 20 is of generally circular configuration in cross-section and is made from a plurality of members 22 which overlap both longitudinally and transversely.

In the example illustrated, four generally part circular foraminous members are provided in the form of stainless steel plates provided with holes approximately two millimeters in diameter and there being more holes per unit area adjacent the front of the furnace box than adjacent the duct 21.

The plates 22 are supported on struts 23 welded to the upper part 11*a* of the peripheral wall 11*b* of the furnace box 11 and provided with suitable support means for the plates. It will be seen that the plates 21 have out-turned flanges 24 at their lower ends for engagement with the lower struts 22.

Means illustrated schematically at 25 are provided to establish, in use, a fluidised bed 26 within the furnace box 11.

In use, products of combustion are constrained to rise vertically from the bed 26 at reduced velocity than would be the case in the absence of the foraminous element 20 and consequently carryover of fluidised material from the bed into the smoke box 13 is eliminated or reduced compared with the amount of carryover which would occur in the absence of the foraminous element 20. Furthermore, because the products of combustion are constrained to rise vertically, and because a greater number of apertures per unit area are provided at the front of the furnace, any tendency for migration of the fluidised bed material towards the rear of the furnace is avoided.

Because the plates 22 are supported from the wall of the furnace box 11, which is water cooled, by struts 23 the plates themselves are likewise water cooled by conduction through the struts 23.

The furnace can be fed with any desired fuel, natural gas, oil or solid fuel.

We claim:

1. A boiler comprising a furnace box, having a peripheral wall, from which products of combustion pass to a smoke box wherein the furnace box comprises a lower compartment, means to establish a fluidized bed in the lower compartment, an upper compartment, an exit connected to said upper compartment for passage of products of combustion from said furnace box, means to isolate said lower compartment from said exit except by communication through said upper compartment and through a foraminous element located in the path of the products of combustion from said lower compartment to said upper compartment; said boiler being of the shell type comprising an outer shell containing a water/steam space of the boiler as well as said furnace box; said furnace box being generally cylindrical and having a longitudinal axis which extends horizontally; and said foraminous element being located above said fluidized bed and being generally part circular in cross-section, said foraminous element having lower ends which are connected to said wall of the box.

2. A boiler according to claim 1 wherein said foraminous element comprises an apertured plate, located adjacent to, and spaced inwardly of, an upper wall part of said furnace box and extending over the majority of the length of said furnace box from a forward end thereof towards a rear end thereof, a duct extending downwardly from a space between said upper wall part of said furnace box and said foraminous element to a generally horizontally extending discharge duct communicating with said smoke box.

3. A boiler according to claim 2 wherein the downwardly extending duct is bounded at one side by a plate depending downwardly from said foraminous element having its lower end embedded in a bed of particulate material to provide a seal to said discharge duct.

4. A boiler according to claim 1 wherein said part circular cross-sectional shape has a centre of curvature coincident with said axis of the furnace box.

5. A boiler according to claim 4 wherein said lower ends of said element are connected to the wall of the furnace box by horizontally extending elements.

6. A boiler according to claim 1 wherein said foraminous element is perforated with a greater number of holes per unit area at the front of the furnace box compared with the rear of the furnace box so as to minimise the possibility of short circuiting of gas by reducing the pressure drop across the element at the front because of the increased flow permitted.

7. A boiler according to claim 1 wherein said foraminous element is made up of a plurality of plates overlapped longitudinally and transversely to accommodate thermal expansion.

8. A boiler according to claim 1 wherein said wall of the furnace box is water cooled and said element is supported from said wall by struts whereby said element is water cooled as a result of conduction of heat through said struts to said water cooled wall of said furnace box.

9. A boiler according to claim 1 wherein the foraminous element is made of stainless steel.

* * * * *